US008866683B2

(12) United States Patent
Wong et al.

(10) Patent No.: US 8,866,683 B2
(45) Date of Patent: Oct. 21, 2014

(54) COMMUNICATION DEVICE AND RECONFIGURABLE ANTENNA ELEMENT THEREIN

(75) Inventors: Kin-Lu Wong, Kaohsiung (TW); Shu-Chuan Chen, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 231 days.

(21) Appl. No.: 13/469,803

(22) Filed: May 11, 2012

(65) Prior Publication Data

US 2013/0257679 A1 Oct. 3, 2013

(30) Foreign Application Priority Data

Mar. 28, 2012 (TW) ..... 101110729 A

(51) Int. Cl.
*H01Q 3/24* (2006.01)

(52) U.S. Cl.
USPC ..... 343/745; 343/876

(58) Field of Classification Search
CPC ..... H01Q 1/243; H01Q 9/42
USPC ..... 343/745, 749, 876
See application file for complete search history.

(56) References Cited

U.S. PATENT DOCUMENTS

2008/0266190 A1 10/2008 Ohba et al.
2009/0128428 A1* 5/2009 Ishizuka et al. ..... 343/702

FOREIGN PATENT DOCUMENTS

EP 2 048 739 4/2009
EP 2 230 723 9/2010
WO 2008/059509 5/2008

OTHER PUBLICATIONS

European Search Report dated Aug. 2, 2012.

* cited by examiner

*Primary Examiner* — Robert Karacsony
(74) *Attorney, Agent, or Firm* — McClure, Qualey & Rodack, LLP

(57) ABSTRACT

A communication device includes a ground element, an antenna element, and a reconfigurable circuit element group. The antenna element includes a first radiating portion and a second radiating portion. One end of the first radiating portion is a feeding end of the antenna element, and the other end is an open end. One end of the second radiating portion is coupled to the ground element, and the other end is an open end. The second radiating portion is longer than the first radiating portion. The second radiating portion surrounds the open end of the first radiating portion, and includes a first portion and a second portion. The reconfigurable circuit element group is coupled between the first portion and the second portion of the second radiating portion, and includes at least two branches. The reconfigurable circuit selectively opens and closes the branches such that the antenna element operates in different bands.

11 Claims, 5 Drawing Sheets

COMMUNICATION DEVICE AND RECONFIGURABLE ANTENNA ELEMENT THEREIN

CROSS REFERENCE TO RELATED APPLICATIONS

This application claims priority of Taiwan Patent Application No. 101110729 filed on Mar. 28, 2012, the entirety of which is incorporated by reference herein.

BACKGROUND OF THE INVENTION

1. Field of the Invention

The disclosure generally relates to a communication device, and more particularly, relates to a communication device with a reconfigurable antenna element.

2. Description of the Related Art

With recent, rapid development in wireless communication technology, a variety of wireless communication devices have been developed and promoted. Among them, the most popular are the mobile communication devices. To satisfy the demand for slim profile and multiple functions, available space in a mobile communication device to accommodate the internal antennas is becoming very limited. It is hence a challenge for an antenna engineer to design an internal antenna capable of multiple functions with a very limited space available.

In order to solve the foregoing problems, there is a need to provide a tunable communication device and an antenna element therein, which can operate in different bands without changing the size of the antenna element.

BRIEF SUMMARY OF THE INVENTION

The invention is aimed to provide a communication device and a reconfigurable antenna element therein. The reconfigurable antenna element comprises an antenna element and a reconfigurable circuit element group. By adjusting the reconfigurable circuit element group, a resonant path of the antenna element is altered without changing the size of the antenna element, and the obtained resonant modes of the antenna element can cover different communication bands. The reconfigurable antenna element of the invention may operate in WWAN/LTE (Wireless Wide Area Network/Long Term Evolution) bands.

In one embodiment, the disclosure is directed to a communication device comprising: a ground element; an antenna element comprising: a first radiating portion, wherein one end of the first radiating portion is a feeding end of the antenna element, and the other end of the first radiating portion is an open end; and a second radiating portion comprising a first portion and a second portion, wherein one end of the second radiating portion is a shorted end coupled to the ground element, the other end of the second radiating portion is an open end, a length of the second radiating portion is greater than a length of the first radiating portion, and the second radiating portion surrounds the open end of the first radiating portion; and a reconfigurable circuit element group coupled between the first portion and the second portion, wherein the reconfigurable circuit element group comprises at least two branches, and the reconfigurable circuit element group selectively opens and closes the branches such that the antenna element operates in different bands.

In the invention, the reconfigurable circuit element group is positioned in the second radiating portion and comprises at least two branches. In an embodiment, the first branch comprises an inductive element, and the second branch comprises a switch for closing or opening the second branch. When the second branch is closed, a resonant path of the second radiating portion substantially goes through the second branch. When the second branch is open, the resonant path of the second radiating portion substantially goes through the first branch. Since the first branch has the inductive element, the frequency of the lowest resonant mode of the second radiating portion can be reduced. By closing or opening the second branch, the frequency of the resonant modes of the second radiating portion is altered such that the antenna element can operate in different bands (Multi-band operation).

In one embodiment, the reconfigurable antenna element is approximately 35 mm in length and 7 mm in width and 3 mm in height (the volume is about 0.74 $cm^3$). The reconfigurable antenna element of the invention may operate in WWAN/LTE eight bands (LTE700/GSM850/900 three bands and GSM1800/1900/UMTS/LTE2300/2500 five bands). In a preferred embodiment, the first radiating portion is excited to generate at least one resonant mode in a higher band (about 1710 MHz to 2690 MHz) of the antenna element to cover at least one communication band. The second radiating portion is excited to generate at least one resonant mode in a lower band (about 700 MHz to 960 MHz) of the antenna element to cover at least one communication band. In addition, the reconfigurable circuit element group is away from the open end and the shorted end of the second radiating portion, and is substantially positioned at a current null of a higher-order resonant mode of the second radiating portion, thereby altering the frequency of the lowest resonant mode of the second radiating portion without affecting the higher-order resonant mode.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
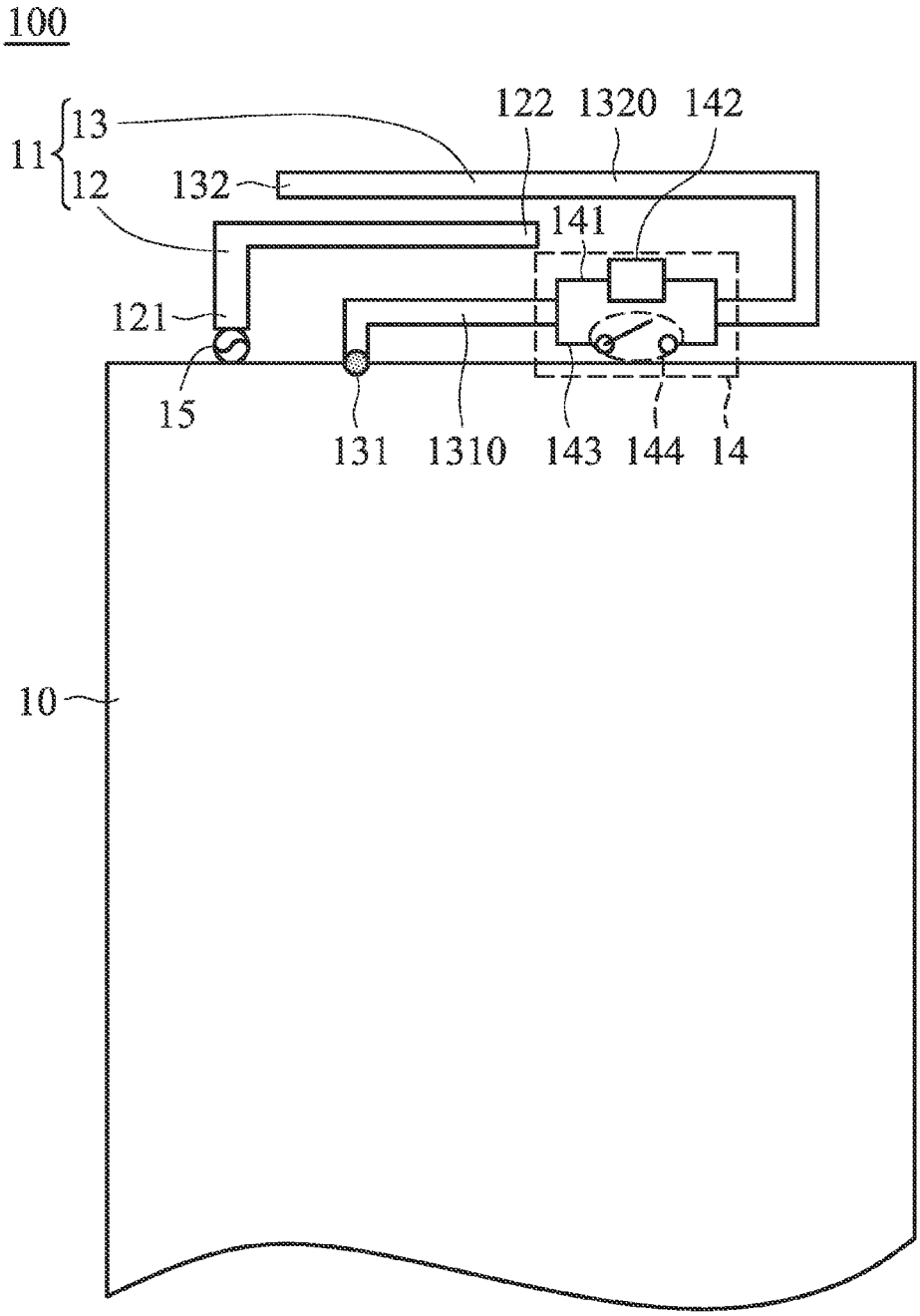
FIG. 1 is a diagram for illustrating a communication device according to a first embodiment.

FIG. 1 is a diagram for illustrating a communication device 100 according to a first embodiment. The communication device comprises a ground element 10, an antenna element 11, and a reconfigurable circuit element group 14. The antenna element 11 comprises a first radiating portion 12 and a second radiating portion 13. One end of the first radiating portion 12 is a feeding end 121 of the antenna element 11, wherein the feeding end 121 is electrically coupled to a signal source 15. The other end of the first radiating portion 12 is an open end 122. The second radiating portion 13 comprises a first portion 1310 and a second portion 1320. One end of the second radiating portion 13 is a shorted end 131 which is electrically coupled to the ground element 10. The other end of the second radiating portion 13 is an open end 132. The length of the second radiating portion 13 is greater than the length of the first radiating portion 12. The second radiating portion 13 substantially surrounds the open end 122 of the first radiating portion 12. The reconfigurable circuit element group 14 is electrically coupled between the first portion 1310 and the second portion 1320 of the second radiating portion 13. The reconfigurable circuit element group 14 comprises at least two branches. The reconfigurable circuit element group 14 selectively opens and closes the branches to change the frequency of the resonant modes of the second radiating portion 13 such that the antenna element 11 operates in different bands. In some embodiments, the reconfigurable circuit element group 14 determines whether to close the branches according to a user input or a control signal generated by a processor (not shown). Notes that the reconfigurable circuit element group 14 is away from the open end 132 and the shorted end 131 of the second radiating portion 13, and the reconfigurable circuit element group 14 is substantially positioned at a current null of a higher-order resonant mode of the second radiating portion 13. In the embodiment, the reconfigurable circuit element group 14 comprises at least a first branch 141 and a second branch 143, wherein the first branch 141 comprises a first inductive element 142 (e.g., a chip inductor), and the second branch 143 comprises a first switch 144 for closing or opening the second branch 143.

Figure 2A:
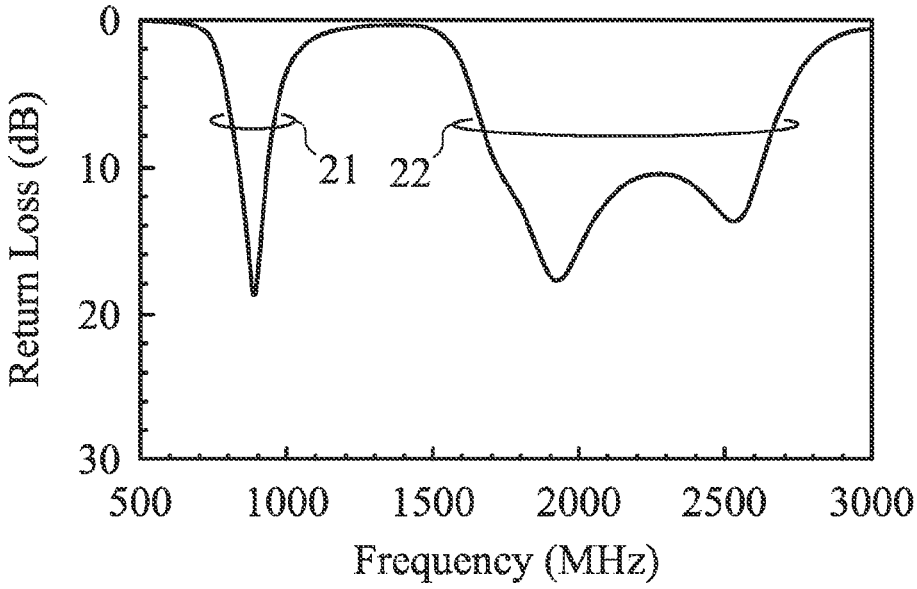
FIG. 2A is a diagram for illustrating return loss of the communication device when a second branch is closed according to the first embodiment.

FIG. 2A is a diagram for illustrating return loss of the communication device 100 when the second branch 143 is closed according to the first embodiment. When the second branch 143 is closed by the first switch 144, the antenna element 11 operates in a first band 21 and a second band 22. The first band 21 is mainly formed by the lowest resonant mode of the second radiating portion 13. The second band 22 is mainly formed by a higher-order resonant mode of the second radiating portion 13 and a resonant mode of the first radiating portion 12. The first and second bands 21 and 22 cover at least a mobile communication band or cover GSM850/900 bands and GSM1800/1900/UMTS bands.

Figure 2B:
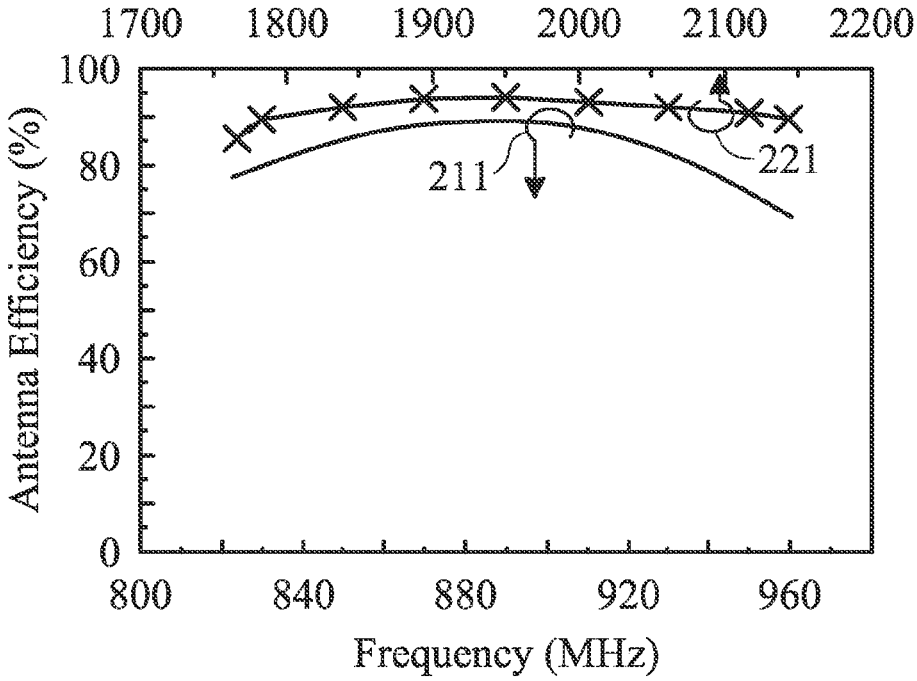
FIG. 2B is a diagram for illustrating antenna efficiency of the communication device when the second branch is closed according to the first embodiment.

FIG. 2B is a diagram for illustrating antenna efficiency of the communication device 100 when the second branch 143 is closed according to the first embodiment. The antenna efficiency curve 211 represents antenna efficiency of the antenna element 11 operating in GSM850/900 bands, and the antenna efficiency curve 221 represents antenna efficiency of the antenna element 11 operating in GSM1800/1900/UMTS bands. The antenna element 11 of the communication device 100 has good antenna efficiency (the antenna efficiency includes the return loss) in GSM850/900 bands and GSM1800/1900/UMTS bands to meet practical applications.

Figure 3A:
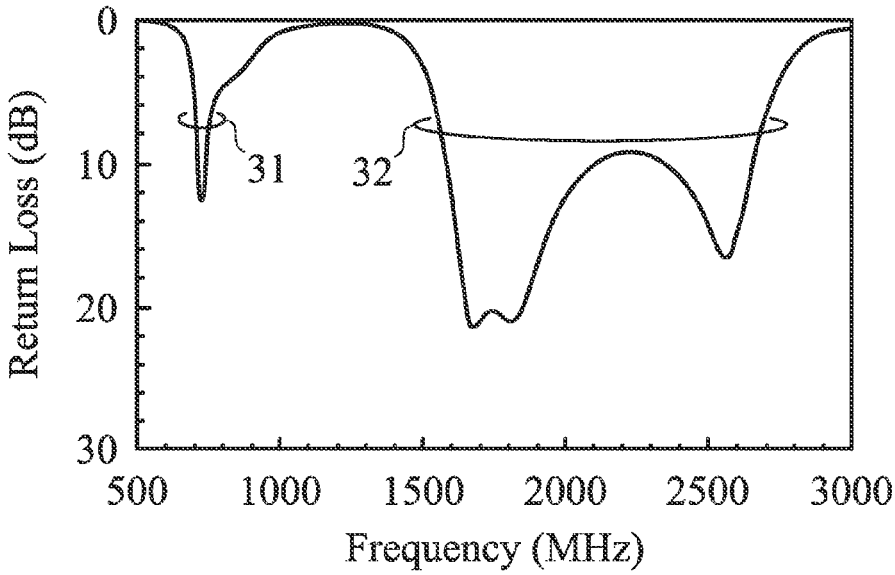
FIG. 3A is a diagram for illustrating return loss of the communication device when the second branch is open according to the first embodiment.

FIG. 3A is a diagram for illustrating return loss of the communication device 100 when the second branch 143 is open according to the first embodiment. When the second branch 143 is opened by the first switch 144, the antenna element 11 operates in a third band 31 and a fourth band 32. The third band 31 is mainly formed by the lowest resonant mode of the second radiating portion 13. The fourth band 32 is mainly formed by a higher-order resonant mode of the second radiating portion 13 and a resonant mode of the first radiating portion 12. The third and fourth bands 31 and 32 cover at least a mobile communication band or cover the LTE700 band and LTE2300/2500 bands.

Figure 3B:
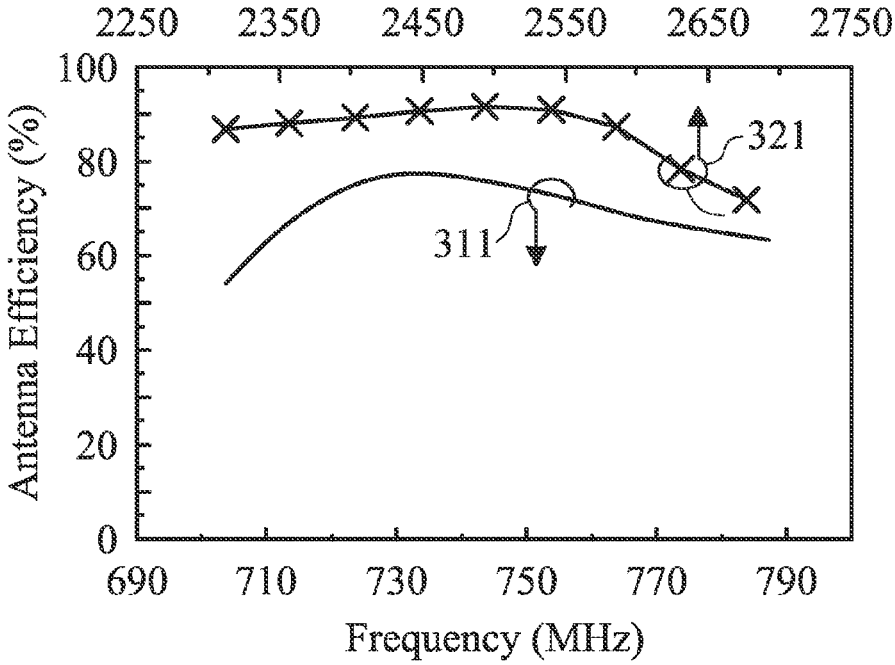
FIG. 3B is a diagram for illustrating antenna efficiency of the communication device when the second branch is open according to the first embodiment.

FIG. 3B is a diagram for illustrating antenna efficiency of the communication device 100 when the second branch 143 is open according to the first embodiment. The antenna efficiency curve 311 represents antenna efficiency of the antenna element 11 operating in an LTE700 band, and the antenna efficiency curve 321 represents antenna efficiency of the antenna element 11 operating in LTE2300/2500 bands. The antenna element 11 of the communication device 100 has good antenna efficiency (the antenna efficiency includes the return loss) in LTE700 band and LTE2300/2500 bands to meet practical applications.

Figure 4:
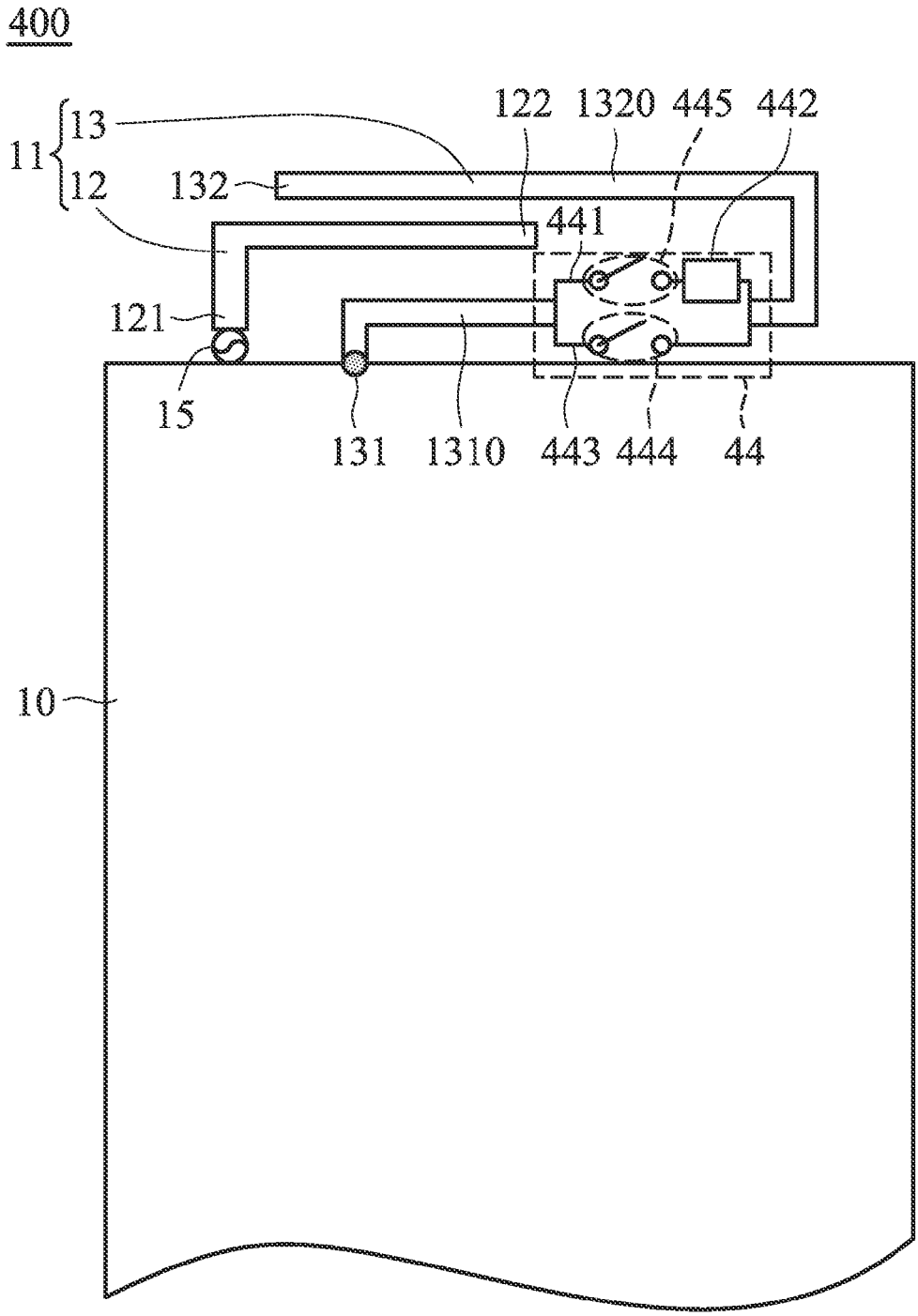
FIG. 4 is a diagram for illustrating a communication device according to a second embodiment.

FIG. 4 is a diagram for illustrating a communication device 400 according to a second embodiment. In the embodiment, two switches are respectively disposed in two different branches of a reconfigurable circuit element group 44 to close or open the branches to select different operation bands. A first branch 441 of the reconfigurable circuit element group 44 comprises a second switch 445 and a first inductive element 442 that are coupled in series. A second branch 443 of the reconfigurable circuit element group 44 comprises a first switch 444. In other embodiments, the second switch 445 may be interchanged with the first inductive element 442. When the second switch 445 closes and the first switch 444 opens, the first inductive element 442 is electrically coupled between the first portion 1310 and the second portion 1320 of the second radiating portion 13. On the contrary, when the second switch 445 opens and the first switch 444 closes, the first portion 1310 is electrically coupled to the second portion 1320 by the second branch 443. Note that in the embodiment, at least one of the first switch 444 and the second switch 445 is closed. Other features of the communication device 400 in the second embodiment are the same as those of the communication device 100 in the first embodiment. Therefore, the communication device 400 in the second embodiment is similar to that in the first embodiment, and is capable of covering WWAN/LTE multiple bands.

Figure 5:
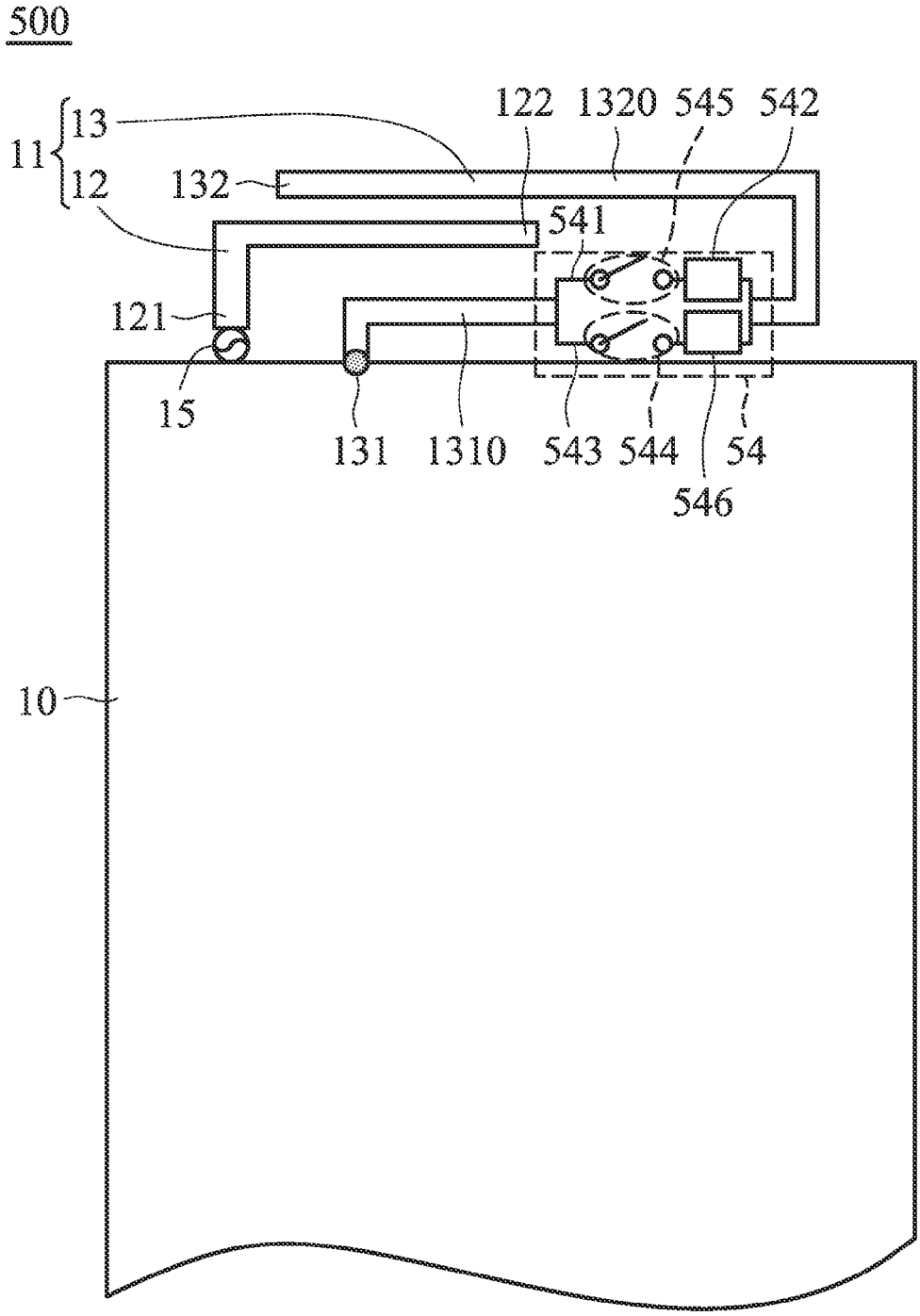
FIG. 5 is a diagram for illustrating a communication device according to a third embodiment.

FIG. 5 is a diagram for illustrating a communication device 500 according to a third embodiment. In the embodiment, a second branch 543 of a reconfigurable circuit element group 54 further comprises a second inductive element 546 (e.g., a chip inductor) in such a manner that the antenna element 11 is further minimized. A first branch 541 of the reconfigurable circuit element group 54 comprises a second switch 545 and a first inductive element 542 that are coupled in series. The second branch 543 of the reconfigurable circuit element group 54 comprises the second inductive element 546 and a first switch 544 that are coupled in series. In other embodiments, the second switch 545 may be interchanged with the first inductive element 542, and the second inductive element 546 may be interchanged with the first switch 544. When the first switch 544 closes and the second switch 545 opens, the second inductive element 546 of the second branch 543 is electrically coupled between the first portion 1310 and the second portion 1320 of the second radiating portion 13. On the contrary, when the first switch 544 opens and the second switch 545 closes, the first inductive element 542 of the first branch 541 is electrically coupled between the first portion 1310 and the second portion 1320 of the second radiating portion 13. In a preferred embodiment, an inductance of the first inductive element 542 is different from that of the second inductive element 546. Note that in the embodiment, at least one of the first switch 544 and the second switch 545 is closed. Other features of the communication device 500 in the third embodiment are the same as those of the communication device 100 in the first embodiment. Therefore, the communication device 500 in the third embodiment is similar to that in the first embodiment, and is capable of covering WWAN/LTE multiple bands. In comparison to the first embodiment, one of the first inductive element 542 and the second inductive element 546 has an inductance greater than that of the first inductive element 142, but the other one has another inductance smaller than that of the first inductive element 142.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element;

an antenna element, comprising:

a first radiating portion, wherein one end of the first radiating portion is a feeding end of the antenna element, and the other end of the first radiating portion is an open end; and a second radiating portion, comprising a first portion and a second portion, wherein a first end of the first portion is shorted-circuited to the ground element, a first end of the second portion is an open end, a length of the second radiating portion is greater than a length of the first radiating portion, and the second radiating portion surrounds the open end of the first radiating portion; and a reconfigurable circuit element group, coupled between a second end of the first portion and a second end of the second portion of the second radiating portion, wherein the reconfigurable circuit element group comprises at least two branches, and the reconfigurable circuit element group selectively opens and closes the branches such that the antenna element operates in different bands.

2. The communication device as claimed in claim 1, wherein the reconfigurable circuit element group comprises a first branch and a second branch, the first branch comprises a first inductive element, and the second branch comprises a first switch for closing or opening the second branch.

3. The communication device as claimed in claim 1, wherein the reconfigurable circuit element group is away from the open end and the shorted end of the second radiating portion, and the reconfigurable circuit element group is substantially positioned at a current null of a higher-order resonant mode of the second radiating portion.

4. The communication device as claimed in claim 2, wherein when the second branch is closed, the antenna element operates in a first band and a second band.

5. The communication device as claimed in claim 4, wherein the first and second bands cover at least a mobile communication band or cover GSM850/900 bands and GSM1800/1900/UMTS bands.

6. The communication device as claimed in claim 4, wherein when the second branch is open, the antenna element operates in a third band and a fourth band.

7. The communication device as claimed in claim 6, wherein the third and fourth bands cover at least a mobile communication band or cover LTE700 band and LTE2300/2500 bands.

8. The communication device as claimed in claim 6, wherein the first radiating portion is excited to generate at least a resonant mode in the second band or the fourth band.

9. The communication device as claimed in claim 6, wherein the second radiating portion is excited to generate at least a resonant mode in the first band or the third band.

10. The communication device as claimed in claim 2, wherein the first branch further comprises a second switch for closing or opening the first branch, and the second switch and the first inductive element are coupled in series.

11. The communication device as claimed in claim 2, wherein the second branch further comprises a second inductive element, and the second inductive element and the first switch are coupled in series.

* * * * *